United States Patent [19]

Grandy

[11] Patent Number: 4,886,159

[45] Date of Patent: Dec. 12, 1989

[54] MULTIKEY CARRIER

[76] Inventor: Clarence E. Grandy, 75 Oaklawn Ave., Stamford, Conn. 06905

[21] Appl. No.: 225,226

[22] Filed: Jul. 28, 1988

[51] Int. Cl.[4] ..... A45C 11/00; A45C 11/32

[52] U.S. Cl. ..... 206/37.4

[58] Field of Search ..... 206/37.1–37.8

[56] References Cited

U.S. PATENT DOCUMENTS

| | | | |
|---|---|---|---|
| 1,507,492 | 9/1924 | Vine | 206/37.1 |
| 2,122,934 | 7/1938 | Economakis | 206/37.4 |
| 2,635,665 | 4/1953 | Ashley | 206/37.4 |
| 2,704,101 | 3/1955 | Wittrien | 206/37.4 |
| 2,859,789 | 11/1958 | Buckett | 206/37.4 |
| 2,915,099 | 12/1959 | Gates | 206/37.4 |
| 3,926,234 | 12/1975 | Dean | 206/37.4 |
| 4,286,641 | 9/1981 | Watson | 206/37.4 |
| 4,417,612 | 11/1983 | Couture et al. | 206/37.4 |

*Primary Examiner*—William Price

*Attorney, Agent, or Firm*—Parmelee, Bollinger & Bramblett

[57] ABSTRACT

A key case is provided for conveniently holding a plurality of keys in an unattached, side-by-side, flat orientation. A plurality of foldable transparent flaps having open top pockets therein adapted to house keys therein by insertion and removal through the open top of the pockets are provided with a foldable flat cover which includes colored reinforcing strands interwoven between the flaps holding the keys and the cover in order to provide strength for the flap mounting to the cover in order to support the added weight when keys are housed in the pockets of the flaps. Dividers are provided for dividing the pockets into a plurality of separated open top key compartments for receiving and separately holding keys in each of the compartments in a flat orientation with the keys being inserted and removed through the open tops of the compartments. A plurality of horizontally extending raised reinforcements strands are vertically spaced and alternately woven on opposite sides of each of the separated compartments for providing support and stability for the keys housed in the compartments. Reinforcing strands of red, blue, gold, yellow, black or other bright color are also vertically interwoven between the compartments to prevent the tearing of the compartments on the insertion and removal of keys therefrom. The compartments are numbered or alphabetically identified from right to left to aid in the identification and removal of a key stored therein by right-handed users and may be numbered or alphabetized in the opposite direction for left-handed users.

5 Claims, 2 Drawing Sheets

MULTIKEY CARRIER

BACKGROUND

This invention relates to a key case for removably holding a plurality of keys therein, and more particularly to a multiple key carrier for holding a plurality of keys in removable, unattached, side-by-side fashion with a flat orientation for easy identification, insertion and removal therefrom.

Handling, storing and using keys have always presented interesting problems. The key ring is bulky, tends to put holes in the pockets in which they are stored, and keyrings are sometimes difficult to add or remove keys therefrom, and are sometimes difficult to use because of the weight and bulk of the large number of keys on the ring. Key cases are also difficult to handle and the various clips or holding means become worn, broken or stuck, making it difficult if not impossible, to add or remove keys from the key case. The identity problem is also difficult, and again there is a bulky, weighty, key case which sometimes provides an awkward problem in inserting a key into a lock and operating the individual key while connected to the key case.

SUMMARY OF THE DISCLOSURE

Accordingly, it is an object of this invention provide a new and improved multikey carrier which permits the unattached, easy access, storage and removal of keys from the carrier.

A further object of this invention is to provide a new and improved multiple key carrier for holding a plurality of keys in a flat orientation in side-by-side fashion for easy identification and storage.

Another object of this invention is to provide a new and improved multikey carrier which is easily handled and has a flat, unbulky configuration which is conveniently stored in pockets or handbags of the users.

Another object of this invention is to provide a new and improved multikey carrier which is easily handled and has a flat, unbulky configuration which is conveniently stored in pockets or handbags of the users.

Still a further object of this invention is to provide a new and improved multikey carrier for holding a plurality of keys in unattached, side-by-side fashion having a flat orientation which carrier is reinforced to provide a gripping action on each stored key as well as strengthening the key case in which it is stored.

In carrying out this invention in one illustrative embodiment thereof, a key case for holding a plurality of keys in an unattached, side-by-side, flat orientation in the case includes a foldable, flat cover having a plurality of foldable transparent flaps having open top pockets therein adapted to house keys therein by insertion and removal through the open top of the pockets in the flap. The flaps are mounted in said foldable flat cover with a reinforcing means interwoven between the flaps and the cover in order to provide additional strength for the flap mounting to the cover for supporting the weight of the keys which are housed in the pockets in the flaps. Divider means are provided for dividing the pockets into a plurality of separated open top key compartments for receiving and separately holding keys therein in a flat orientation with the keys being inserted and removed through the open top of the compartment. A plurality of horizontally extending raised reinforcing means vertically spaced and alternately woven on opposite sides of each of the separated compartments are provided for supporting and stabilizing the keys housed in the compartments. Raised reinforcement means ar also vertically interwoven between the compartments to prevent the tearing of the compartments on the repeated insertion and removal of the key therefrom.

The compartments are conveniently numbered from right to left to aid in the identification of the keys stored therein by right-handed users. The numerals may be reversed for left-handed users.

BRIEF DESCRIPTION OF THE DRAWINGS

The invention together with further objects, aspects, features and advantages thereof, will be more clearly understood from the following description taken in connection with the accompanying drawings in which like reference numerals are used on like elements throughout the various views. The drawings are not necessarily to scale, being arranged for clarity of illustration.

DESCRIPTION OF THE PREFERRED EMBODIMENTS

Figure 1:
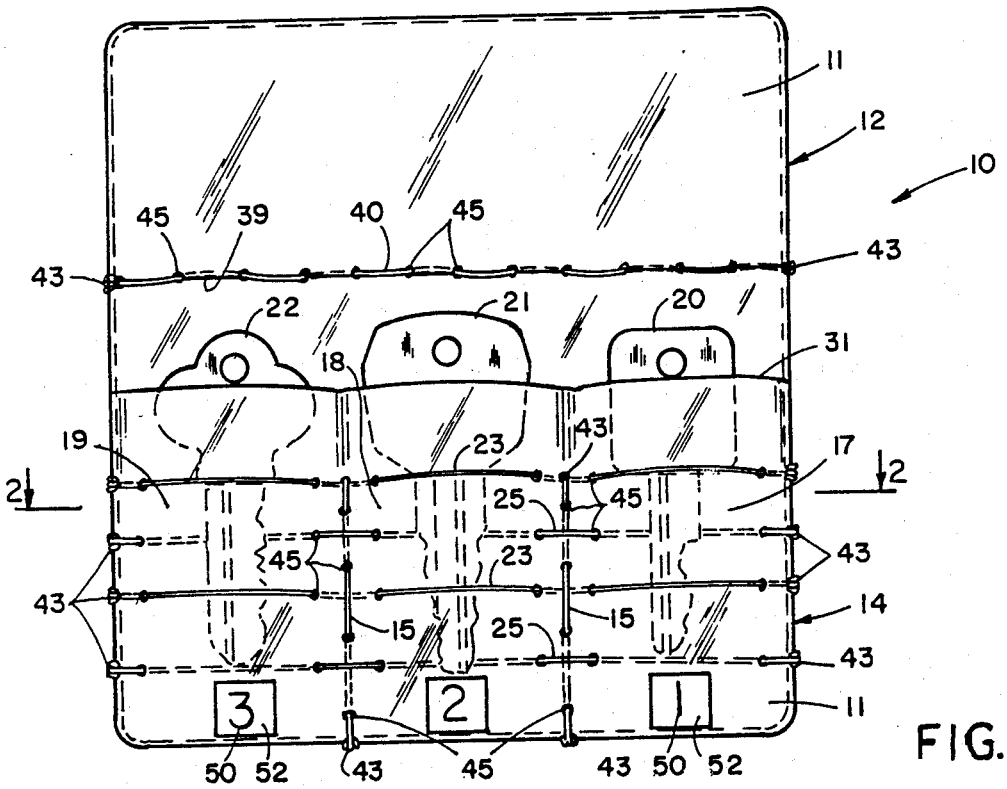
FIG. 1 is a top plan view of the multikey carrier of the present invention with the cover shown partly open exposing a first foldable flap housing three keys in a flat orientation.

Referring now to FIG. 1, a multikey carrier, indicated generally with the reference numeral 10, includes a foldable flat cover 12 and has a plurality of foldable, transparent flaps 14, 24, 34 and 44 (See FIG. 4) of stiffly flexible transparent sheet plastic material 11. These flaps 14, 24, 34 and 44 each has an open top pocket 16 therein. The front and rear foldable, transparent flaps 14 and 44 are integrally joined at a center hinge 39. The intermediate flaps 24 and 34 are also integrally joined at this center hinge 39 and these four flaps are mounted in the transparent foldable cover 12 by raised interlaced strand 40 of suitable fiber, string or twine which is woven through and extends on opposite sides of the joined covers and flaps for foldably securing the flaps along the central interlaced strand hinge line 39.

As seen most clearly in FIG. 1, this strand 40 is secured by knotting at 43, at each end of the strand. This strand 40 alternately extends along opposite sides of the hinge line 39, being laced or passed through small openings 45 substantially uniformly spaced along the hinge line 39. Thus, the cover 12, and the pairs of flaps 14-44 and 24-34 are secured together by this strand 40, which may be brightly colored as explained above.

Each of the foldable transparent flaps contains an open top pocket 16 therein which, as illustrated in FIG. 1, is divided into multiple separate compartments by vertically extending divider means 15 which are vertically interwoven or interlaced between compartments 17 and 18, and 18 and 19, to divide the pocket 16 so that keys 20, 21, and 22, respectively, may be stored individually and in a flat orientation in the compartments 17, 18, and 19. The raised reinforcement interwoven means 15 in the form of strands of fiber, string or twine not only provide the divider means for separating the compartments and preventing tearing of the stiffly flexible transparent sheet plastic 11 which forms the wall surfaces and cover of the multikey carrier 10. The interlaced means 15 add strength when the keys are inserted and removed from the respective compartments 17, 18 and 19 and produce a squeezing frictional grip of the transparent plastic material 11 on each key. The reinforcement, interwoven-compartment-separator means 15 includes a strand secured by knotting at 43 and alternately extending along opposite sides of the flap 14, being laced or passed through small openings 45 spaced vertically as seen in FIG. 1 along the dividing line between the respective adjacent compartments 17, 18 and 19. It is to be understood that the flap 14 includes a rear wall 33 (FIG. 2) which extends to the center hinge 39 and also includes a front wall 35 (FIG. 3) which terminates at a lip 31 (FIG. 1) at the upper limit of the front wall of the pocket 16.

A plurality of horizontally extending raised reinforcement means 23 and 25 are vertically spaced and alternately woven on opposite sides of each of the separated compartments 17, 18 and 19 for providing support and stability and squeezing grip for keys 20, 21, 22 housed in the respective compartments 17, 18 and 19. As will be apparent from FIGS. 1 and 2 interwoven or interlaced reinforcement strands 23 extend above the front wall 35 over each of the keys 20, 21 and 22 and extend under the vertical dividing strands 15. Conversely, the other two strands 25 extend under the rear wall 33 beneath each of the keys 20, 21 and 22 and extend over the dividing strands 15. Accordingly, the horizontally extending reinforcing means 23 and 25 alternately surround the separated compartments 17, 18 and 19 and the keys 20, 21 and 22 respectively, housed therein providing support and stability for the keys housed in the compartments and providing a squeezing sandwich-like gripping action of the rear and front walls 33, 35 on each key. These reinforcement and sandwich-like gripping means 23, 25 are secured in place by knotting at 43 at the edge of the flap 14. The strands which form these reinforcement and sandwich-like gripping means are laced or passed through small openings 45 in the rear and front transparent walls 33, 35. These strands may be brightly colored as discussed above.

Figure 2:
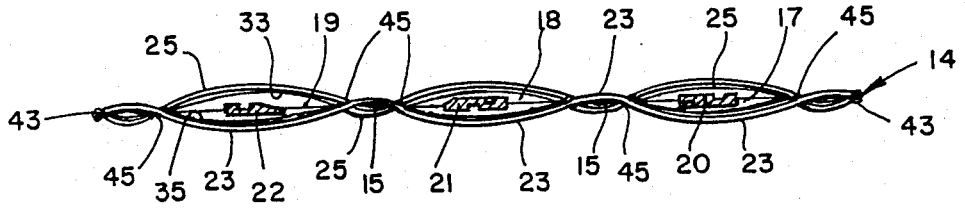
FIG. 2 is a cross-sectional view of a single, foldable flap taken along line 2—2 of FIG. 1.

By virtue of these reinforcement and sandwich-like gripping means 23, 25, when a key is inserted into a compartment the reinforcing horizontally extending strands 23 and 25 cause the front and rear walls 35, 33 to frictionally grip the key in sandwich-like manner as seen most clearly in FIG. 2 and keep it stored in position in its respective compartment, while also adding strength to that compartment for the many times that the key will be inserted and removed therefrom.

FIG. 2 clearly illustrates the interweaving relationship of the horizontally extending reinforcing strands 23 and 25 laced through small openings 45 and which totally interweave and alternate around each of the keys 20, 21 and 22 and around the vertical dividing strands 15. This reinforcing structure 23, 25 not only divides the pockets 16 of the flap 14 into compartments 17, 18 and 19 but it also supplies reinforcement and strength to the front and rear walls 35, 33 and provides a gripping action on the key in the pocket in addition to the strengthening of that pocket.

Figure 3:
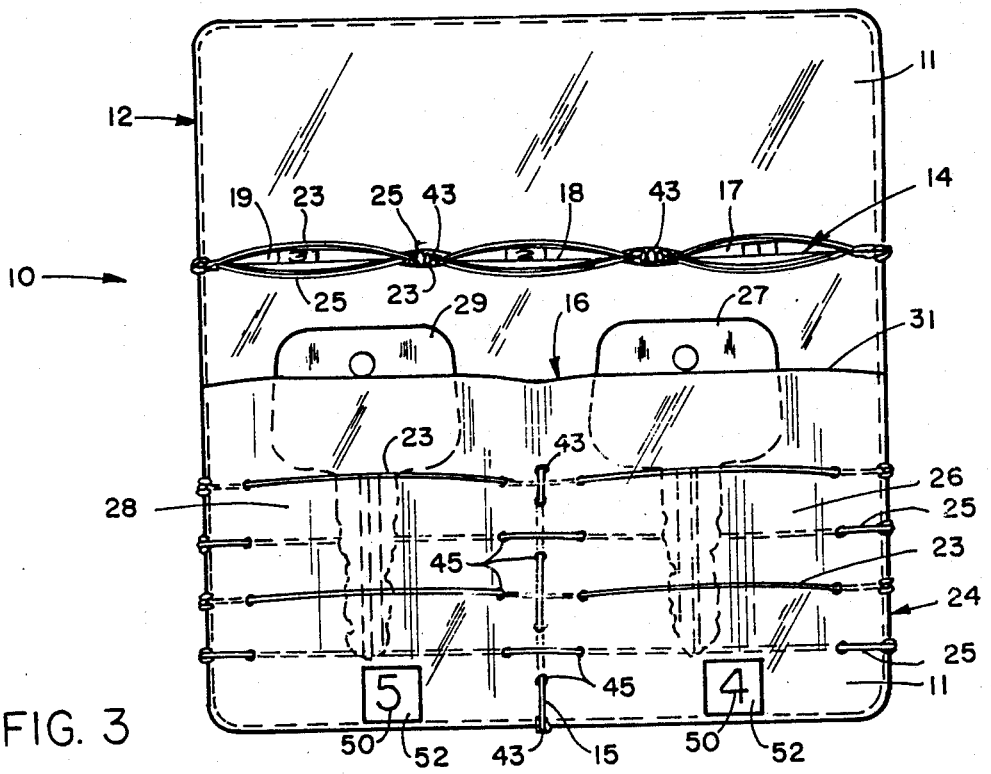
FIG. 3 is a top plan view similar to FIG. 1, except that FIG. 3 is showing the foldable flap of FIG. 1 elevated in edge view and exposing another foldable flap having two compartments, housing two keys.

FIG. 3 illustrates that the first intermediate foldable flap 24 is divided into two compartments instead of three, namely key compartments 26 and 28 by the divider means 15 for housing larger size keys 27 and 29, respectively. The same horizontally extending interwoven strands 23 and 25 alternatively surround by interlacing the compartments 26 and 28 holding keys 27 and 29, respectively, in a manner similar to that shown in the three compartment arrangement of the flap 14 seen in FIGS. 1 and 2.

As will be understood from FIGS. 1 and 3, the keys 20, 21 and 22, and 27 and 29 are housed in their respective compartments in a separated unattached, side-by-side convenient flat orientation in their respective flaps and may be readily identified by numerical designations 1–5 which conveniently for a right-handed person are numbered from right to left. Instead of numbers, letters may be used to designate the respective compartments. The multikey carrier may be held in the left hand by a right-handed person and the keys conveniently removed using the fore finger and thumb of the right hand. For left-handed people the compartments may be numbered or lettered for the convenience of the left-handed user from left to right.

Figure 4:
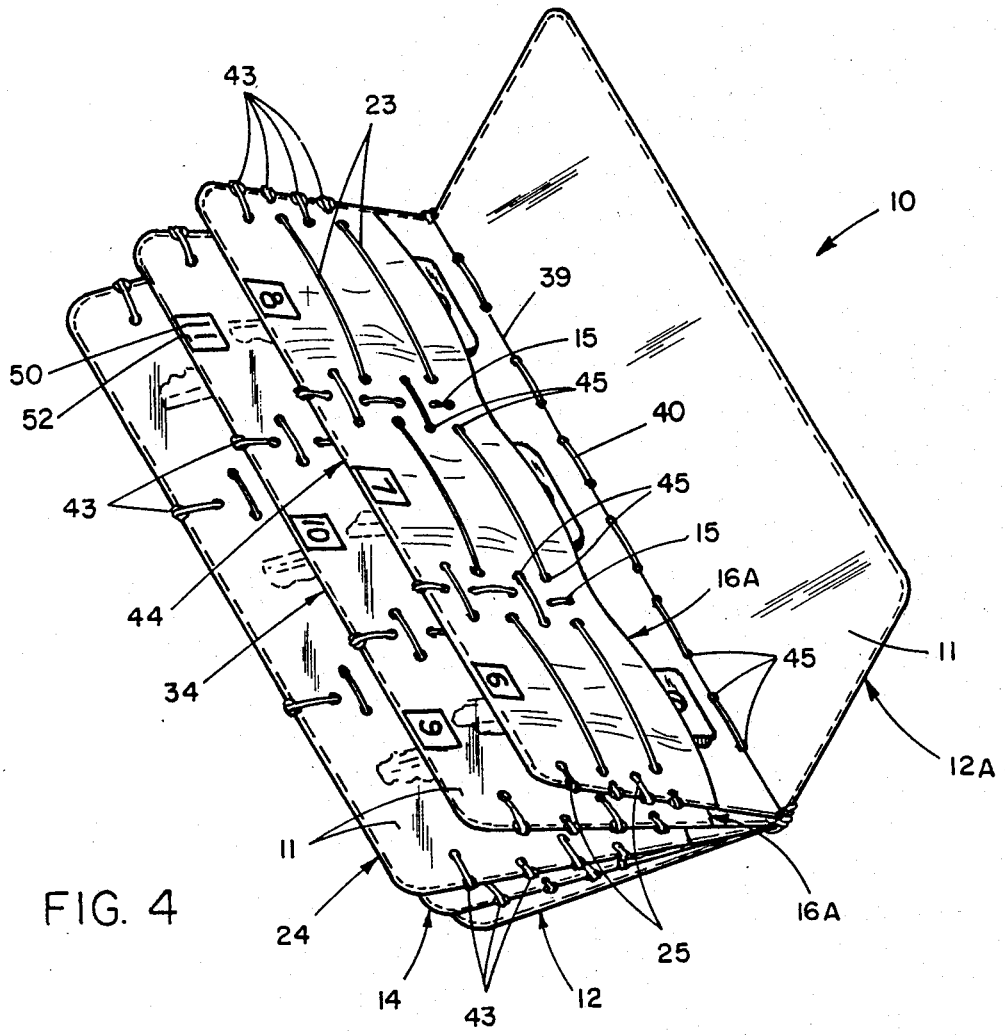
FIG. 4 is a perspective view of the multikey carrying case illustrated in FIGS. 1–3 which has been turned over, with the cover shown part way open for showing two additional flaps, providing a total of four key-holding flaps, whereby the entire embodiment is capable of housing 11 keys.

FIG. 4 illustrates the key case of the embodiment of FIGS. 1–3 turned over in which the flaps 34 and 44 are each divided into three key compartments designated from right to left by the respective numbers 6 through 11. The cover is seen to comprise a front cover flap 12 in FIGS. 1 and 3. In FIG. 4 the rear cover flap 12A is seen clearly. Both of these cover flaps 12 and 12A are of transparent material 11 similar to the material of the walls of the key-holding pocket flaps 44, 34, 24 and 14.

Thus the user can advantageously see through the cover and through the compartments the shapes of many of the keys for ease of selection, or for reminding the user about the desired key, before opening the front or rear cover flap 12 or 12A.

In order to obtain access to the keys held in the compartments of the intermediate flaps 24 and 34, the outer pocket flaps 14 or 44 are swung open on their hinge 39, as will be understood from FIG. 4.

The keys in compartments designated by 1, 2, 3, 4 and 5 (FIGS. 1 & 3) are obtained when the carrier 10 is facing up in the position of FIGS. 1 and 3 with the front cover 12 opened. The keys in compartments designated by 6, 7, 8, 9, 10 and 11 are obtained when this convenient key holder unit 10 is turned over, as shown in FIG. 4, with the rear cover 12A opened.

It will be apparent from the above detailed description that other embodiments may be provided using for example, 4 or 6 pocket flaps for housing a multiple number of keys, depending on the number of compartments into which each of the pocket flaps is divided.

As explained above, the pocket flaps 14 and 44 form an integral outer pair having their respective rear walls 33 integrally connected at the hinge 39 and positioned so that their respective front-facing and rear-facing pockets 16 and 16A open in opposite directions away from each other in back-to-back relationship as seen in FIG. 4. Similarly, the pocket flaps 24 and 34 form an integral inner pair having their rear walls 33 integrally connected at the hinge 39 and positioned with their respective front-facing and rear-facing pockets 16 and 16A respectively, opening in opposite directions away from each other in back-to-back relation, as seen in FIG. 4. The cover flaps 12 and 12A are integral with each other, being integrally joined at the hinge 39. The strand 40 extending along the hinge line 39 is laced through small openings 45 in the sheet material 11 of the integral cover 12–12A aligned with small openings in the sheet material 11 of the integral rear wall 33 of the respective pairs of pocket flaps 14–44 and aligned with small openings in the sheet material 11 of the integral rear wall 33 of the respective pairs of pocket flaps 24–34. Thus, these small holes 45 allow the laced strand 40 to pass through three layers of the plastic material 11 for uniting the cover 12–12A with the outer and inner pairs of pocket flaps 14–44 and 24–34.

Thus, such a multikey carrier may comprise multiple pairs of such pocket flaps, with the respective pockets each sub-divided into two or three key compartments. The compartment-designating numbers 50, or letters when used, are printed on labels 52 affixed to the bottom of the front wall of the respective compartment.

Separating and carrying the various keys in a flat, side-by-side orientation with ready identification solves many of the problems now common to other methods of carrying keys, for example such as key cases and key rings. When the keys are housed in the compartments in accordance with the present invention, the keys cannot fall out of their individual pockets while the key carrier is closed. The covers 12 and 12A prevent keys from dislodging from the compartments in the outer pocket flaps 14 and 44. The outer pocket flaps 14 and 44, in turn, serve as covers to prevent keys from dislodging from the compartments in the inner pocket flaps 24 and 34. A majority of the respective key extends down into the pocket and is gripped by the compartment walls (FIG. 2) held in sandwich-like gripping relationship by the horizontally extending vertically spaced assembly of reinforcing strands 23 and 25 to hold and retain the key in its respective compartment. The key may be easily removed and then used individually in a lock separately from the other keys, which is more convenient and easier to handle than a large group of keys on a ring or in the situation where the key extends from a key case, where the weight of the key case and its bulkiness make the key operation of a lock more difficult and inconvenient for the user. The flat orientation of the keys provided in the multikey carrier of the present invention enables convenient handling and storage of the carrier itself while providing a key carrier with a flat configuration which facilitates carrying in a clothing pocket and use by the owner.

Since other changes and modifications varied to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents of the claimed elements.

What is claimed is:

1. A key case for holding a plurality of keys in an unattached side-by-side flat orientation in said case comprising:

a foldable flat cover, a plurality of foldable transparent flaps having open therein, said flaps being foldable with said cover, divider means for dividing said pockets into a plurality of separated open top key compartments which are adaptable to receive and hold keys therein in a flat, unattached configuration with the keys being inserted and removed through the open top of said compartments, and a plurality of horizontally extending means alternatively woven on opposite sides of said separated compartments to provide support and stability of keys housed therein.

2. The key case as claimed in claim 1 wherein said divider means includes reenforcing means vertically woven between said compartments to insure the separation integrity of said compartments.

3. The key case as claimed in claim 2 wherein said compartments are numbered numerically from right to left to aid in the identification of the keys which are stored therein.

4. A key case for holding a plurality of keys in an unattached, side-by-side flat orientation in said case, a foldable flat cover, a plurality of foldable transparent flaps having open top pockets therein adapted to house keys therein by insertion and removal through said open top of said pockets in said flap, said flaps being mounted in said foldable flat cover with a reenforcing means interwoven between said flaps and said cover in order to provide additional strength for the flap mounting to said cover in order to support the added weight when keys are housed in said pockets in said flaps, divider means for dividing said pockets into a plurality of separated open top key compartments for receiving and separately holding keys therein in a flat orientation with the keys being inserted and removed through the open top of said compartments, a plurality of horizontally extending raised reenforcement means vertically spaced and alternately woven on opposite sides of each of said separated compartments for providing support and stability for keys housed in said compartments, raised reenforcement means vertically interwoven between said compartments to prevent the tearing of said compartments on the insertion and removal of keys therefrom.

5. The key case as claimed in claim 4 wherein said compartments are numbered from right to left to aid in the identification of a key stored therein.

* * * * *